United States Patent [19]

Stewart et al.

[11] Patent Number: 4,530,133

[45] Date of Patent: Jul. 23, 1985

[54] OPENING ROLLER FOR OPEN END SPINNING MACHINES

[75] Inventors: William R. Stewart, Craigmount; David B. Stewart, Newtyle; John M. C. Dickinson, Largoward, By Elie, all of Scotland

[73] Assignee: Wm. R. Stewart & Sons (Hacklemakers) Ltd., Dundee, Scotland

[21] Appl. No.: 577,877

[22] Filed: Feb. 7, 1984

[30] Foreign Application Priority Data

Feb. 25, 1983 [GB] United Kingdom ..... 8305376

[51] Int. Cl.[3] ..... D01G 9/14

[52] U.S. Cl. ..... 19/97; 19/112

[58] Field of Search ..... 19/97, 112, 128, 223; 57/408; 29/121.1, 121.4, 121.5, 121.6, 124, 125, 130, 116 R

[56] References Cited

U.S. PATENT DOCUMENTS 4,196,496 4/1980 Stauffer et al. ..... 19/97
4,300,265 11/1981 Heinen ..... 19/112

FOREIGN PATENT DOCUMENTS 2015299 4/1970 France .
319552 9/1926 United Kingdom .
278511 10/1927 United Kingdom .
1048200 11/1966 United Kingdom .
1,510,623 5/1978 United Kingdom .
1517273 7/1978 United Kingdom .
2011966 7/1979 United Kingdom ..... 19/97

*Primary Examiner*—Louis K. Rimrodt
*Assistant Examiner*—J. L. Kravitz
*Attorney, Agent, or Firm*—Cushman, Darby & Cushman

[57] ABSTRACT

An opening roller for an open end spinning machine which may be formed in one or two parts, the opening roller having a central body or hub (1) preferably provided with a central cylindrical aperture (10) therein for mounting on a drive shaft of an open end spinning machine, there being an outer ring (2) having a cylindrical external surface (7), the ring (2) supporting suitable combing elements in the form of spaced pins (14) or card wire and wherein the ring (2) is spaced from and connected to the central body (1) by means of septal walls (3) which may either extend radially or be inclined to respective radial planes passing through them, and wherein the spaces between the septal walls may be filled with a suitable plastics medium (11) which may surround the pin tails (18) if these project from the rear face (19) of the ring (2). The roller may be machined from a one-piece extrusion (FIG. 2) or after suitable machining may be assembled from two parts which may themselves be extruded.

20 Claims, 4 Drawing Figures

OPENING ROLLER FOR OPEN END SPINNING MACHINES

This invention relates to an opening roller for open end spinning machines.

Opening rollers for open end spinning machines are known comprising toothed working surfaces or combing elements of card wire or pins set in a detachable ring carried on a core or body with or without extra clamping means. Such multi-part rollers are complicated and thus expensive to manufacture, because of the necessary machining operations, and all have the disadvantage that in practice additional manufacturing tolerances are required which increases the cost and tends to reduce the accuracy of the final point surface when measured with respect to the spindle upon which the opening roller is mounted.

Opening rollers are also known where the card wire or pins are directly attached to the body of the roller. In other words, the pinned or card wired ring is integral with the body. These integral rollers are either heavy or, if hollow, are liable to be deformed in fitting or in use. Such rollers are difficult to manufacture, and often the ring is connected to the body by an integral radially extending end wall. Such a roller is shown in No. FR-A-2368555.

The present invention provides a means of producing a lighter integral design of opening roller without the necessity for complex machining operations. It has also been found that the roller body can conveniently be cut from a suitable extrusion.

According to the present invention, we provide an opening roller comprising an outer ring having a generally cylindrical external surface carrying combing elements such as card wire or pins, said ring being connected to a central body by means of septal walls which preferably extend axially.

The number of septal walls depends on the details of the design, bearing in mind the necessary rigidity of the ring and the required stiffness of the whole roller.

If necessary, the radial end faces of the roller can be closed off with cover plates. Alternatively, or additionally, the spaces between the septal walls can be filled by a suitable plastics medium. Any desired features for reducing the build-up of fly, controlling airflows and so forth can then be machined into the end faces of the roller, or cover plate, or into the plastics medium if this is provided.

In the case of opening rollers which are to be covered with wire, the septal walls can be radial.

In the case of opening rollers which are pinned, it may be convenient to arrange the septal walls to lie parallel to the pins in their immediate vicinity. This can allow the manufacturer to avoid the necessity for drilling blind holes and can allow longer pins to be used without the tails interfering with the septal walls. In this case, the walls may be generally tangential to the central body.

One embodiment of the invention is now described by way of example with reference to the accompanying drawings, in which.

Figure 1:
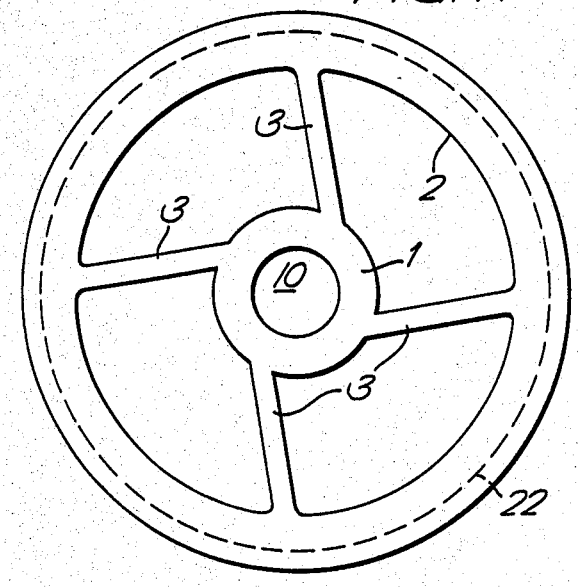
FIG. 1 is an end view of an extrusion from which opening rollers are formed.
Figure 2:
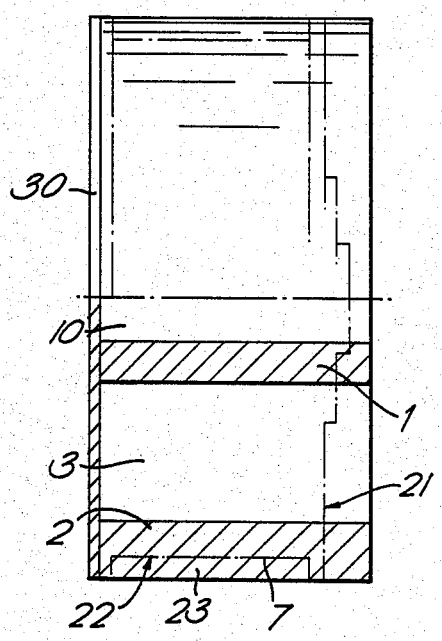
FIG. 2 is a part sectioned side view showing a short length of extrusion showing in outline some of the machining necessary to produce an opening roller.

Referring now to FIGS. 1 and 2, a roller is formed from an extrusion comprising a hub or central body 1 and a cylindrical ring 2 which are connected to each other by a number of, in this case four, axially extending septal walls 3. In FIG. 2, the lines 21 and 22 indicate the final outline of one particular form of opening roller which may be machined from a short length of the extrusion, and which is shown more fully in FIG. 3.

Figure 4:
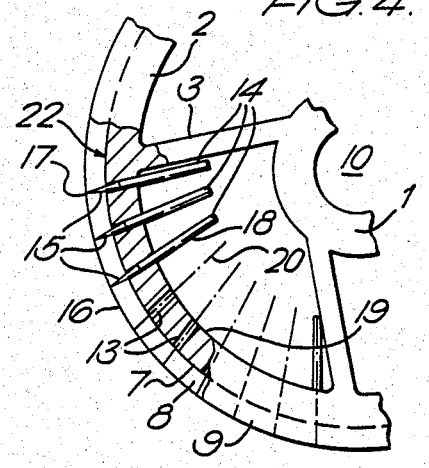
FIG. 4 is a part sectioned scrap view of a pinned opening roller but showing only some of the pins, and no plastics medium.
Figure 3:
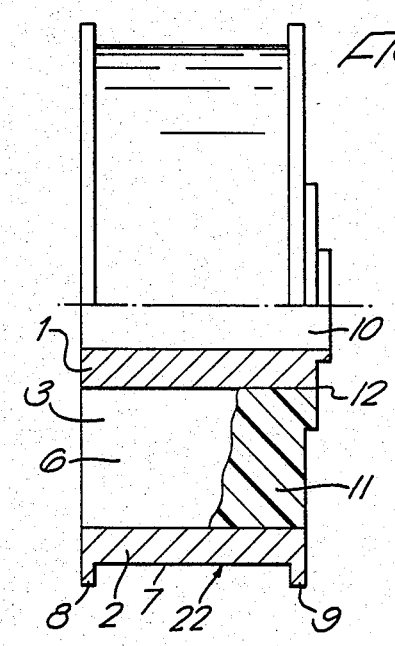
FIG. 3 is a side view of an opening roller formed from the extrusion of FIG. 1, partly sectioned on a radial plane, showing the interior partly filled with a plastics medium.

As can be seen from FIGS. 2, 3 and 4, a portion 23 is machined from the extrusion to provide an outer cylindrical surface 7 which lies between radially extending flanges 8 and 9. The surface 7 can be provided with pins 14 or card wire (or any other suitable combing elements to form a working surface) for combing out fibres in the usual manner. The hub 1 has a central cylindrical bore 10 which should be concentric with the outer cylindrical surface 7 to ensure that the combing surface 16 of the opening roller (defined by the tips of the pins 14) runs true.

A cover plate 30 (see FIG. 2) may be provided closing off at least one of the end faces of the roller.

In FIG. 3, one face 6 of a septum or septal wall 3 is shown, partially obscured at one side by a representation of a plastics filler medium 11. It will be seen that any desired features—such as one or more narrow cylindrical projections 12 which interact with a bearing unit to form a baffle—can be machined into the end face of the roller.

As can be seen in FIG. 4, a plurality of pin bores 13 is provided in the ring 2. In some of these bores, pins 14 with points 15 are shown so as to project from the outer cylindrical surface 7 of the ring 2. The ends 17 of the pins all lie on a circle which thus defines the combing surface 16. This combing surface 16 may be coincident with the outside edges of the flanges 8, 9, but is preferably slightly inside or below them. The flanges 8, 9 thus can serve to protect the pin points 15 from accidental damage. The pins 14 may be secured in the bores 13 by any usual means. The tails 18 of the pins 14 may project behind the rear face 19 of the ring 2 but they may alternatively be fitted so as to be flush with said rear face. The centre-lines 20 of the pins 14 are shown inclined to the normal to the surface 7 of the ring 2, i.e. they are not quite radially orientated. The angle can be freely chosen within wide limits depending on the diameter and thickness of the ring 2 and the diameter of the pins 14 but should be chosen to produce the optimum spinning performance on an open end spinning machine. It is also preferred that in the region of the walls 3, the pins are substantially parallel to these walls. In other words, the septal walls 3 and pins 14 should preferably make a similar angle to the normal to the ring surface 7 to avoid the pin tails 18 (if present) fouling the walls. As shown in FIG. 1, the walls 3 extend generally tangential to (or parallel to tangents to the surface of) the hub or body 1. In other words, the septal walls 3 are inclined to radial planes drawn through their points of connection to the ring 2 or to the body 1.

As will be clear from the foregoing description, numerous modifications of the invention are possible but a common feature of all embodiments is the interconnection between the hub or body 1 of the opening roller and the peripheral ring 2 which carries the fibre combing elements being achieved by means of a plurality of septal walls 3 (which are preferably axially extending).

Although the invention has been described in the form of a single multi-hollow extrusion, it is possible to produce pinned rollers in accordance with the invention on the basis of a single hollow tubular extrusion which provides a cylindrical ring, with a plurality of internal fins which co-operate with a second, substantially cylindrical hub to form a composite opening roller. In this latter case, use can be made of the angled fins together with their natural resilience to effect a simple but firm frictional attachment of the finned ring to the hub. Alternatively, of course, the fins could be formed integral with the hub, and be assembled with a plain ring.

These embodiments are particularly applicable for pinned rollers where the provision of features to co-operate with the sleeve of the bearing element make a relatively larger diameter hub essential.

The opening roller can be formed from any suitable material, such as aluminium, brass or plastics, and the septal walls can be radial or inclined to the radial direction, e.g. generally tangential to the central hub 1, as illustrated. Furthermore, the walls may extend generally axially, or be inclined to the longitudinal axis of the roller. If they extend axially the roller may initially be formed as an extrusion, and then cut into short lengths, and finally may be machined as necessary.

What is claimed is:

1. An opening roller for open end spinning machines comprising a one-piece extrusion including a central body; an outer ring having a generally cylindrical external surface; and a plurality of septal walls connecting said ring to said central body; said external surface including combing elements penetrating said external surface and extending outwardly from said external surface.

2. An opening roller according to claim 1 wherein the septal walls extend axially.

3. An opening roller according to claim 1 wherein four septal walls are provided.

4. An opening roller according to claim 1 and including a cover plate closing off at least one of the end faces of the roller.

5. An opening roller according to claim 1 and including a plastics medium in the spaces between the septal walls.

6. An opening roller according to claim 1 wherein said septal walls extend radially from said central body.

7. An opening roller according to claim 1 wherein said septal walls are inclined to a radial plane drawn through their point of connection to said ring or to their point of connection to the body.

8. An opening roller according to claim 7 wherein said combing elements comprise pins, and wherein a plurality of pins is located in said ring so as to project from its cylindrical surface, said pins in the vicinity of said septal walls extending generally parallel thereto.

9. An opening roller as recited in claim 1 wherein said septal walls each have a portion thereof extending substantially along the entire length of the interior surface of the ring, and a portion extending substantially along the entire length of the central body.

10. An opening roller according to claim 1 wherein said combing elements comprise pins, and wherein a plurality of pins are located in said ring so as to project from its cylindrical surface, said pins in he vicinity of said septal walls extending generally parallel thereto.

11. An opening roller as recited in claim 1 wherein said combing elements extend completely through said external surface, having a blunt portion within the volume defined by said external surface, and having a point extending generally radially outwardly from said external surface.

12. An opening roller for open end spinning machines comprising a one-piece extrusion of a central body, an outer ring having a generally cylindrical external surface and adapted to carry combing elements, and a plurality of septal walls connecting said ring to said central body; wherein said septal walls each have a portion thereof extending substantially along the entire length of the interior surface of the ring, and a portion extending substantially along the entire length of the central body.

13. An opening roller according to claim 12 wherein said septal walls are inclined to a radial plane drawn through their point of connection to said ring or to their point of connection to the body.

14. An opening roller according to claim 13 wherein said combing elements comprise pins, and wherein a plurality of pins is located in said ring so as to project from its cylindrical surface, said pins in he vicinity of said septal walls extending generally parallel thereto.

15. An opening roller according to claim 12 wherein said combing elements comprise pins, and wherein a plurality of pins are located in said ring so as to project from its cylindrical surface, said pins in he vicinity of said septal walls extending generally parallel thereto.

16. An opening roller according to claim 12 and including a cover plate closing off at least one of the end faces of the roller.

17. An opening roller for open end spinning machines comprising a one-piece extrusion including a central body; an outer ring having a generally cylindrical external surface; and a plurality of septal walls connecting said ring to said central body; said external surface including combing elements extending outwardly therefrom.

18. An opening roller according to claim 17 wherein said combing elements comprise pins, and wherein a plurality of pins is located in said ring so as to project from its cylindrical surface, said pins in the vicinity of said septal walls extending generally parallel thereto.

19. An opening roller as recited in claim 17 wherein said septal walls each have a portion thereof extending substantially along the entire length of the interior surface of the ring, and a portion extending substantially along the entire length of the central body.

20. An opening roller according to claim 17 wherein said septal walls are inclined to a radial plane drawn through their point of connection to said ring or to their point of connection to the body.

* * * * *